United States Patent [19]

Moriguchi et al.

[11] Patent Number: 4,518,645

[45] Date of Patent: May 21, 1985

[54] TRANSFER TYPE HEAT SENSITIVE RECORDING MEDIUM

[75] Inventors: Haruhiko Moriguchi; Toshiharu Inui, both of Kanagawa, Japan

[73] Assignee: Fuji Xerox Co., Ltd., Tokyo, Japan

[21] Appl. No.: 531,795

[22] Filed: Sep. 13, 1983

[30] Foreign Application Priority Data

Sep. 13, 1982 [JP] Japan ..... 57-158203

[51] Int. Cl.[3] ..... B41M 5/26

[52] U.S. Cl. ..... 428/212; 428/216; 428/488.4; 428/913; 428/914

[58] Field of Search ..... 101/128.21, 128.4, 470, 101/471; 156/155, 234, 235, 240, 277; 427/143; 428/195, 200, 207, 211, 212, 334, 336, 337, 480, 484, 486, 488, 537, 913, 914, 216, 488.4, 488.1, 537.5

[56] References Cited

U.S. PATENT DOCUMENTS 4,058,644 11/1977 DeVries et al. ..... 8/471

4,444,808 4/1984 Kikuchi et al. ..... 427/143

*Primary Examiner*—Bruce H. Hess

*Attorney, Agent, or Firm*—Sughrue, Mion, Zinn, Macpeak & Seas

[57] ABSTRACT

A transfer type heat sensitive recording medium includes a base member and an ink layer formed thereon of a colored ink which is adapted to be fluidized or sublimated at a predetermined temperature higher than room temperature. The surface of the ink layer is covered with a coating layer of a coating material which is adapted to be dissolved into the ink layer or sublimated when heated at a temperature higher than a predetermined temperature.

2 Claims, 7 Drawing Figures

TRANSFER TYPE HEAT SENSITIVE RECORDING MEDIUM

BACKGROUND OF THE INVENTION

The present invention is directed to transfer type heat sensitive recording medium adapted to be employed in a transfer type heat sensitive recording device and more specifically to a transfer type heat sensitive recording medium of the type having a base layer, an ink layer, and a coating layer which can be dissolved into the ink layer when heated to a specific temperature.

In a transfer type heat sensitive recording device, thermal pulses are applied to a transfer type heat sensitive recording medium so that ink is selectively transferred onto a recording sheet to record picture data.

FIG. 1 shows a conventional method of applying thermal pulses to such a heat sensitive recording medium. The recording medium 10 is prepared by forming an ink layer 12, 4 to 10 μm in thickness on one surface of a base sheet 11 about 10 to 20 μm in thickness. The base sheet 11 is, for instance, of condenser paper. The ink layer 12 is made of a material which is fluidized or sublimated by heating. The base sheet 11 is brought in contact with a thermal head 21 and thermal pulses are applied to the heat sensitive recording medium 10 when the sheet 11 comes to desired positions. A thermal pulse advances in the base sheet 11 radially as indicated by the arrows to the ink layer 12 to heat a part 13A of the latter. As a result, the part 12A of the ink layer 12 which has been fluidized or sublimated by heating is transferred onto a recording sheet (or an ordinary sheet) which is placed on the ink layer 12.

In the conventional transfer type heat-sensitive recording medium, the part 12A of the ink layer which is transferred by diffusion of heat in the base sheet is considerably wide. That is, the width $l_1$ of the part 12A is much larger than the application width $l_0$ of the thermal pulse from a heat supplying source such as the thermal head 21. Accordingly, the resolution is limited.

FIG. 2 is a graphical representation indicating the thicknesses of base sheets with the corresponding upper limits of resolution when the base sheets are of condenser paper. If the base sheet is relative thick, then the resultant resolution is not sufficient. Accordingly, when a recording is to be made with high resolution, it is essential to use a thin base sheet. However, employment of a thin base sheet suffers from the drawback that the heat-sensitive recording medium becomes wrinkled or wavy while being conveyed.

SUMMARY OF THE INVENTION

In view of the foregoing, an object of this invention is to provide a transfer type heat sensitive recording medium which can record pictures with high quality irrespective of the thickness of a base sheet used.

The foregoing object of the invention has been achieved by the provision of a transfer type heat sensitive recording medium in which an ink layer, which is fluidized or sublimated when heated, is formed on a base sheet and a thin coating layer, which is molten or sublimated at a temperature higher than the ink layer, is formed on the surface of the ink layer, so that application of thermal pulses is made from the side having the coating layer.

The foregoing and other objects, features and advantages of the invention will be apparent from the following more particular description of a preferred embodiment of the invention, as illustrated in the accompanying drawings.

DETAILED DESCRIPTION OF THE INVENTION

This invention will be described with reference to a preferred embodiment in detail.

Figure 1:
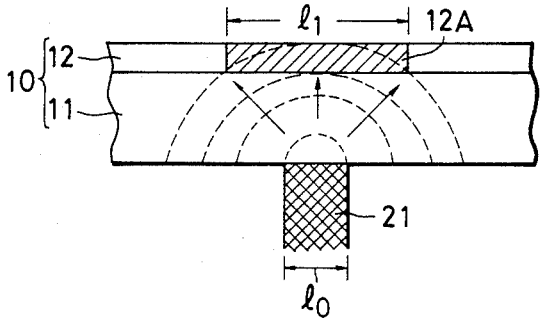
FIG. 1 is a schematic view of a conventional arrangement for applying thermal pulses to a transfer type heat sensitive recording medium.
Figure 2:
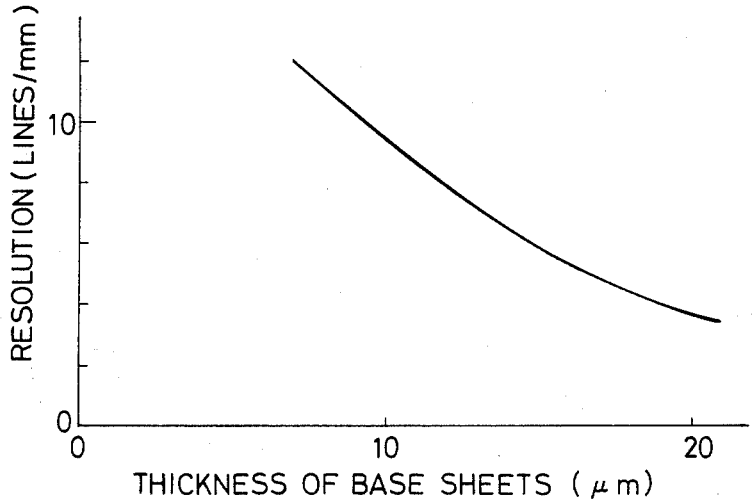
FIG. 2 is a characteristic diagram illustrating an example of the relation between the thickness of a base sheet in a conventional transfer type heat sensitive recording medium and the corresponding resolution.
Figure 3:
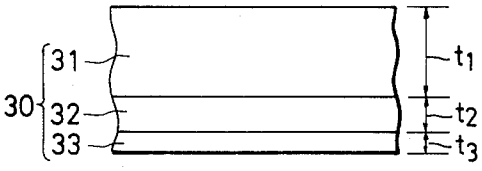
FIG. 3 is an enlarged side elevation view showing a portion of a transfer type heat sensitive recording medium according to one embodiment of the present invention.

FIG. 3 is an enlarged view of a part of the side of a transfer type heat-sensitive recording medium according to an embodiment of the invention. Base sheet 31 is of condenser paper or polyester film, and has a thickness $t_1$ of 10 to 15 μm. An ink layer 32 is formed of ink including black pigment which is thermally molten. The ink layer 32 has a thickness $t_2$ of 3 to 8 μm and a melting point of 70° C. A mixture of ester wax, carnauba wax, carbon black and softening agent is suitable as the black recording ink. This ink is substantially equivalent to that of a heat-sensitive recording medium employed in a conventional thermal-transfer type recording method. A uniform coating layer 33 is formed on the surface of the ink layer 32. The layer 33 is of polyethylene wax, for instance, and has a thickness $t_3$ of 0.5 to 3 μm. The coating layer is molten when heated and has a melting point of approximately 90° C. The coating layer may be formed of a material which is sublimated when heated. In this connection, it is essential that (1) the coating layer does not stick to a heating part such as the thermal head and (2) it is not stuck to or deposited on the heating part when molten. Accordingly, not only polyethylene wax but also ester wax or carnauba wax may be employed to form the coating layer.

Figure 4:
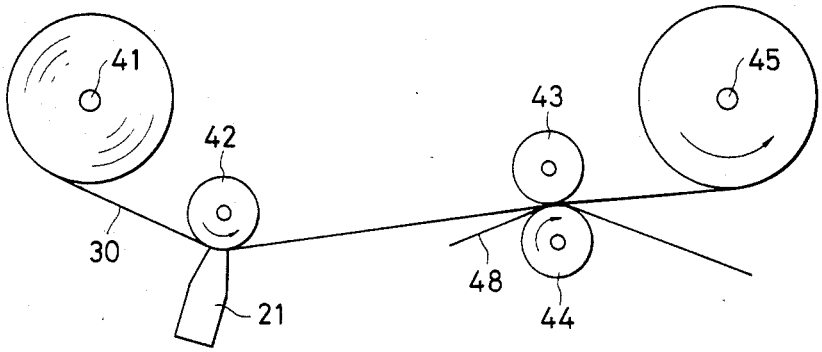
FIG. 4 is a schematic view of an arrangement of a heat sensitive recording device which uses the recording medium according to the present invention.

FIG. 4 shows the essential components of a heat-sensitive recording device which uses the above-described transfer type heat sensitive recording medium. In the device, the heat sensitive recording medium 30 is supplied from a sheet supplying roll 41, and is then wound on a sheet winding roll 45 after successively passing between a thermal head 21 and a pressing roll 42 and between a heat roll 43 and a drive roll 44. In the device, the thermal head 21 is provided on the coating layer side, and the heat roll 43 is on the base sheet side.

Figure 5:
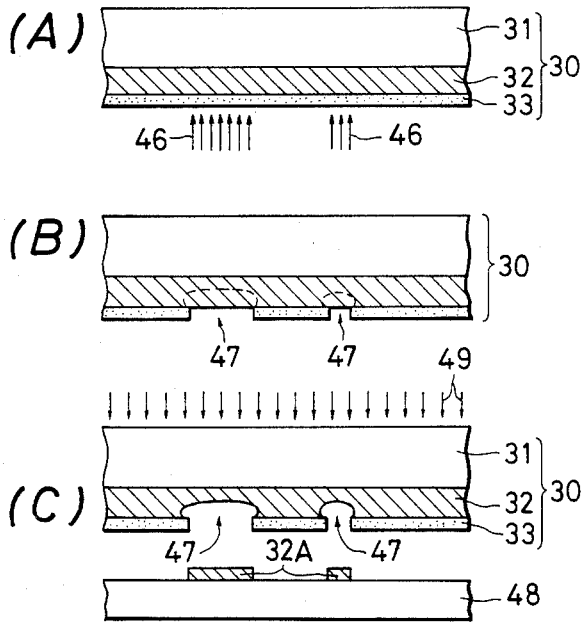
FIGS. 5A–5C are schematic side elevation views showing the steps of recording data in a recording device utilizing the transfer type heat sensitive recording medium according to the present invention.

When a picture signal is supplied to the heat-sensitive recording device thus constructed, the pressing roll 42, the drive roll 44 and the sheet winding roll 45 turn in the directions of the arrows, respectively, and the recording medium 30 runs at a constant speed. Under this condition, the thermal head 21 having heat generating elements arranged in the widthwise direction of the recording medium 30 (or perpendicularly to the surface of the drawing) is driven for every line. As a result, thermal pulses 46 are selectively applied to the coating layer 33 as shown in FIG. 5A. The portions of the coating layer 33 to which the thermal pulses 46 are applied are used to print data in a predetermined color such as black. These portions, being heated to higher than 90° C. are dissolved into the ink layer 32 as shown in FIG. 5B. That is, only the portions of the coating layer 33 to which the thermal pulses 46 have been applied are removed therefrom. The coating layer 33 is thin and is heated while being directly in contact with the thermal head 21. Therefore, the regions 47 of the portions which have been dissolved are substantially equal in size to the regions of application of the thermal pulses 46.

As the recording advances the part of the recording medium 30 where the recording started approaches the drive roll 44. With this timing, a recording sheet 48 from a sheet supplying tray (not shown) approaches the drive roll 44. The recording sheet 48 passes through the heat roll 43 and the drive roll 44 while being maintained in contact with the coating layer 33 of the recording medium. In this operation, thermal energy 49 is uniformly supplied from the side of the base sheet 31 of the recording medium as shown in FIG. 5C. The thermal energy 49 reaches the ink layer 32 through the base sheet 31 to melt the ink layer 32 at a temperature slightly higher than 70° C. As a result, the ink flows through the removed regions 47 of the coating layer, thus being transferred onto the recording sheet 48 which is in contact with the coating layer 33. In the case where thermally sublimated ink is used, the sublimated ink is cooled and solidified on the surface of the recording sheet 48; that is, the ink is transferred onto the recording sheet. FIG. 5C shows the recording sheet 48 which has been removed from the heat-sensitive recording medium 30 after recording. The recording sheet 48 thus removed is delivered to a sheet discharging tray. The inks 32 transferred onto the recording sheet 48 are exactly in correspondence to the regions 47 and accordingly the recorded picture is high in resolution.

As is apparent from the above description, the transfer type heat sensitive recording medium according to the present invention is advantageous in that it is excellent in thermal response and can record data at high speed, because it has the coating layer which responds directly to thermal pulses.

While the invention has been particularly shown and described with reference to a preferred embodiment thereof, it will be understood by those in the art that the foregoing and other changes in form and details may be made therein without departing from the spirit and scope of the invention.

What is claimed is:

1. A transfer type heat sensitive recording medium comprising a base sheet, an ink layer on one surface of said base sheet of a colored ink which is adapted to be fluidized or sublimated at a predetermined temperature higher than room temperature, and a coating layer on said ink layer of a coating material which is adapted to be dissolved into said ink layer or sublimated when heated at a temperature higher than said predetermined temperature.

2. A transfer type heat sensitive recording medium as set forth in claim 1 wherein said base sheet is comprised of condenser paper or polyester film having a thickness from 10 to 15 μm, said ink layer is comprised of wax, a coloring agent and a softening agent having a thickness from 3 to 8 μm and said coating layer is comprised of a wax material having a thickness from 0.5 to 3 μm.

* * * * *